US010806186B2

(12) United States Patent
Liu

(10) Patent No.: US 10,806,186 B2
(45) Date of Patent: Oct. 20, 2020

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 330 days.

(21) Appl. No.: 16/045,709

(22) Filed: Jul. 25, 2018

(65) Prior Publication Data

US 2019/0364966 A1 Dec. 5, 2019

(30) Foreign Application Priority Data

May 29, 2018 (CN) ..... 2018 1 0529978
May 29, 2018 (CN) ..... 2018 2 0812601 U

(51) Int. Cl.

| | |
|---|---|
| ***A24F 13/00*** | (2006.01) |
| ***A24F 47/00*** | (2020.01) |
| ***A24F 7/02*** | (2006.01) |
| ***H05B 3/44*** | (2006.01) |

(52) U.S. Cl.

CPC ..... *A24F 47/008* (2013.01); *A24F 7/02* (2013.01); *H05B 3/44* (2013.01); *H05B 2203/021* (2013.01)

(58) Field of Classification Search

CPC ..... A24F 47/00
USPC ..... 131/328–329
See application file for complete search history.

(56) References Cited

U.S. PATENT DOCUMENTS

| | | | | |
|---|---|---|---|---|
| 2015/0305403 | A1* | 10/2015 | Coelho Belo Fernandes De Carvalho ..... | A24F 47/008 131/328 |
| 2017/0354182 | A1* | 12/2017 | Liu ..... | A24F 47/008 |
| 2019/0069598 | A1* | 3/2019 | Liu ..... | A24F 47/008 |
| 2019/0142069 | A1* | 5/2019 | Qiu ..... | A24F 47/008 131/329 |

* cited by examiner

*Primary Examiner* — Phuong K Dinh
(74) *Attorney, Agent, or Firm* — Matthias Scholl P.C.; Matthias Scholl

(57) ABSTRACT

An electronic cigarette including a mouthpiece subassembly; an e-liquid storage subassembly; an atomizing subassembly; and a base subassembly. The mouthpiece subassembly is mounted on the e-liquid storage subassembly. The atomizing subassembly is disposed in the e-liquid storage subassembly. The base subassembly is connected to the e-liquid storage subassembly. The mouthpiece subassembly includes a cigarette holder, a fixed cover, a first seal ring, a first fixed ring, a decoration cover, a flexible cover, and a sliding part. The cigarette holder is inserted in the fixed cover. The first seal ring is disposed in the fixed cover to seal the cigarette holder. The first fixed ring is disposed outside the fixed cover to fix the flexible cover. The decoration cover is disposed on the flexible cover. The sliding part is disposed at the bottom of the flexible cover.

4 Claims, 7 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 201810529978.5 filed May 29, 2018 and Chinese Patent Application No. 201820812601.6 filed May 29, 2018. The contents of all of the aforementioned applications, including any intervening amendments thereto, are incorporated herein by reference. Inquiries from the public to applicants or assignees concerning this document or the related applications should be directed to: Matthias Scholl P C., Attn.: Dr. Matthias Scholl Esq., 245 First Street, 18th Floor, Cambridge, Mass. 02142.

BACKGROUND

This disclosure relates to an electronic cigarette.

An electronic cigarette or e-cigarette is a cigarette substitute. It gives small amounts of the chemical nicotine without the tobacco or other chemicals from real cigarettes.

Typically, a mouthpiece assembly is non-detachably connected to an e-liquid storage subassembly of the electronic cigarettes. This increases the difficulty to replace the mouthpiece assembly and to load the e-liquid.

SUMMARY

The disclosure provides an electronic cigarette. The e-liquid can be charged to the electronic cigarette from the top part of the electronic cigarette.

Disclosed is an electronic cigarette comprising a mouthpiece subassembly; an e-liquid storage subassembly; an atomizing subassembly; and a base subassembly. The mouthpiece subassembly is mounted on the e-liquid storage subassembly; the atomizing subassembly is disposed in the e-liquid storage subassembly; the base subassembly is connected to the e-liquid storage subassembly.

The mouthpiece subassembly comprises a cigarette holder, a fixed cover, a first seal ring, a first fixed ring, a decoration cover, a flexible cover, and a sliding part; the cigarette holder is inserted in the fixed cover; the first seal ring is disposed in the fixed cover to seal the cigarette holder; the first fixed ring is disposed outside the fixed cover to fix the flexible cover; the decoration cover is disposed on the flexible cover; the sliding part is disposed at a bottom of the flexible cover.

The e-liquid storage subassembly comprises an e-liquid leakproof part, a silica fixed ring, a second fixed ring, a second seal ring, a glass tube, a hollow threaded column, and a third fixed ring; the e-liquid leakproof part and the silica fixed ring are fixed on the second fixed ring; the glass tube sleeves the hollow threaded column; the second seal ring is disposed in the second fixed ring to seal the glass tube; the second fixed ring is disposed on the hollow threaded column; the third fixed ring is screwed on the hollow threaded column to fix the glass tube; the second fixed ring comprises a groove which corresponds to the sliding part of the mouthpiece subassembly; the e-liquid storage subassembly is connected to the mouthpiece subassembly via the cooperation of the sliding part and the second fixed ring.

The atomizing subassembly comprises a limit cover, a heating wire support, an insulation ring, and an electrode; the electrode is embedded in the insulation ring; the insulation ring is disposed in the heating wire support; the heating wire support is disposed in the limit cover; the atomizing subassembly is disposed in the hollow threaded column.

The base subassembly comprises a joint, a protective part of the joint, a vapor adjusting ring, a fourth fixed ring, a third seal ring, a fourth seal ring, and a base; the base subassembly is connected to the atomizing subassembly via the joint; the protective part and the joint are sequentially disposed in the base; the vapor adjusting ring is fixed on the fourth fixed ring; the third seal ring seals the base, and the fourth seal ring seals the vapor adjusting ring; the fourth seal ring, the fourth fixed ring, and the third seal ring are sequentially disposed on the base; the vapor adjusting ring is screwed on the base; the base is screwed on the hollow threaded column of the e-liquid storage subassembly.

The flexible cover can be slidably disposed on the second fixed ring; the second fixed ring can comprise a side wall; the side wall can be provided with an orifice allowing the e-liquid to pass through; and the flexible cover can be capable of sliding on the side wall to seal the orifice.

The vapor adjusting ring can be in threaded connection to the base, and the vapor adjusting ring can comprise a circumferential wall which is provided with a transverse and/or longitudinal hole.

The cigarette holder can employ a common cigarette holder on the market, and is easy to replace. When the e-liquid is used up, the flexible cover is pushed aside, the orifice on the side wall of the second fixed ring is exposed, so that the e-liquid can be charged into the atomizer of the electronic cigarette, achieving the loading of the e-liquid from the top part of the electronic cigarette through a push mode. The vapor adjusting ring is disposed at the bottom of the atomizer, and is in threaded connection to the base, so the rotation of the vapor adjusting ring can change the output volume of the vapor, achieving the vapor adjustment through the bottom of the electronic cigarette. The atomizing subassembly is supported by the base subassembly. The base subassembly can be screwed out to replace the atomizing subassembly.

DETAILED DESCRIPTION

Figure 1:
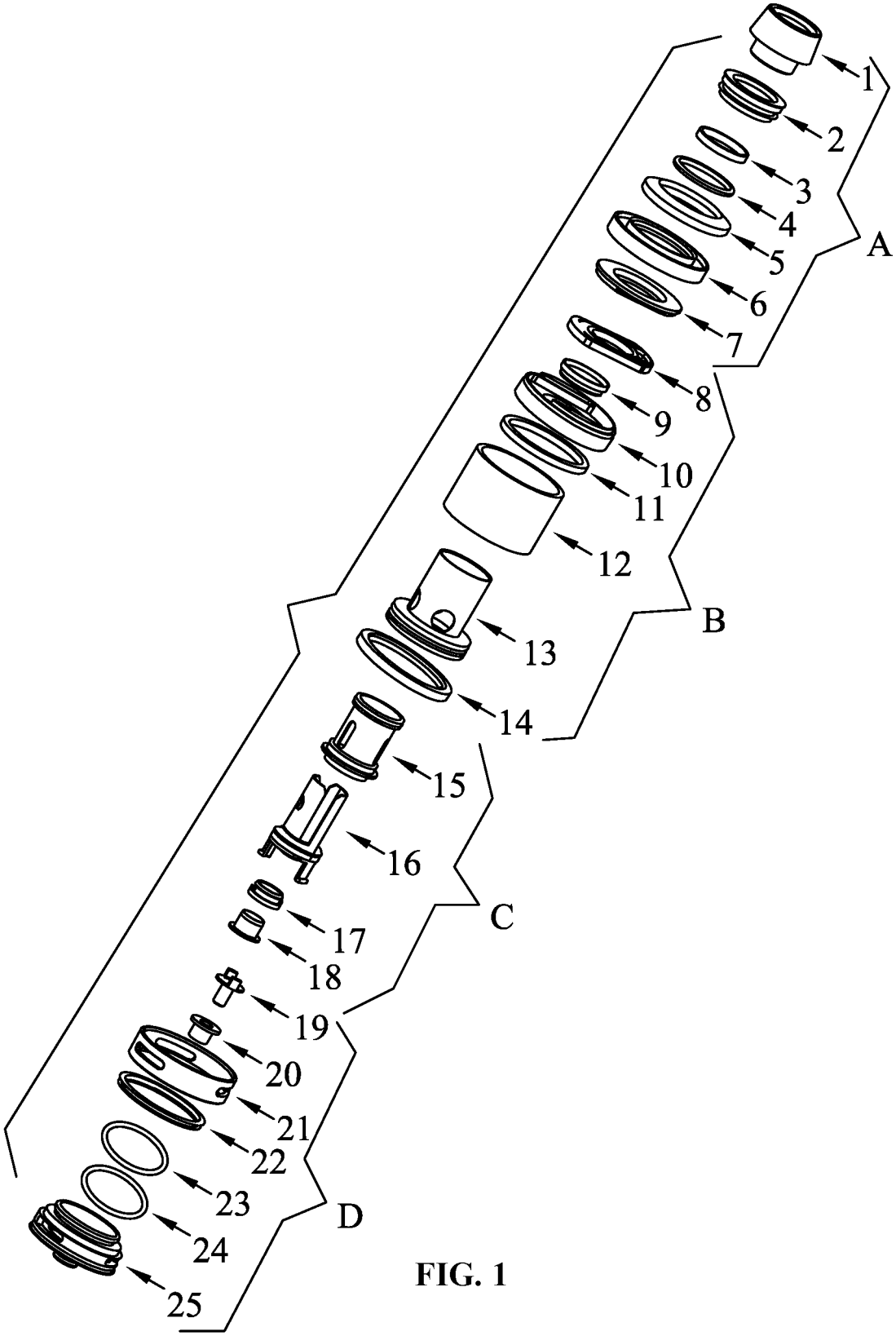
FIG. 1 is an exploded view of an electronic cigarette of the disclosure.
Figure 2:
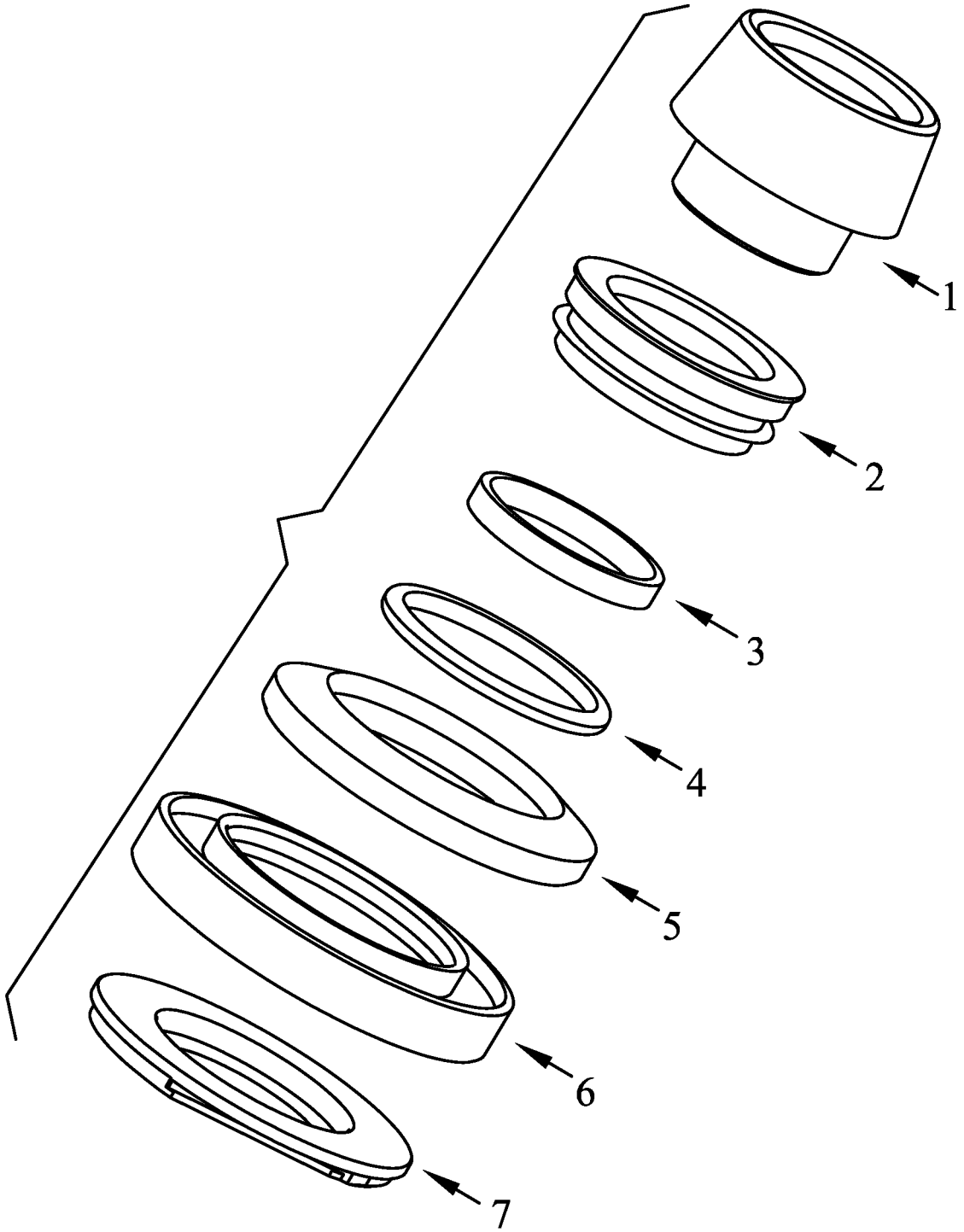
FIG. 2 is an exploded view of a mouthpiece subassembly of an electronic cigarette of the disclosure.
Figure 3:
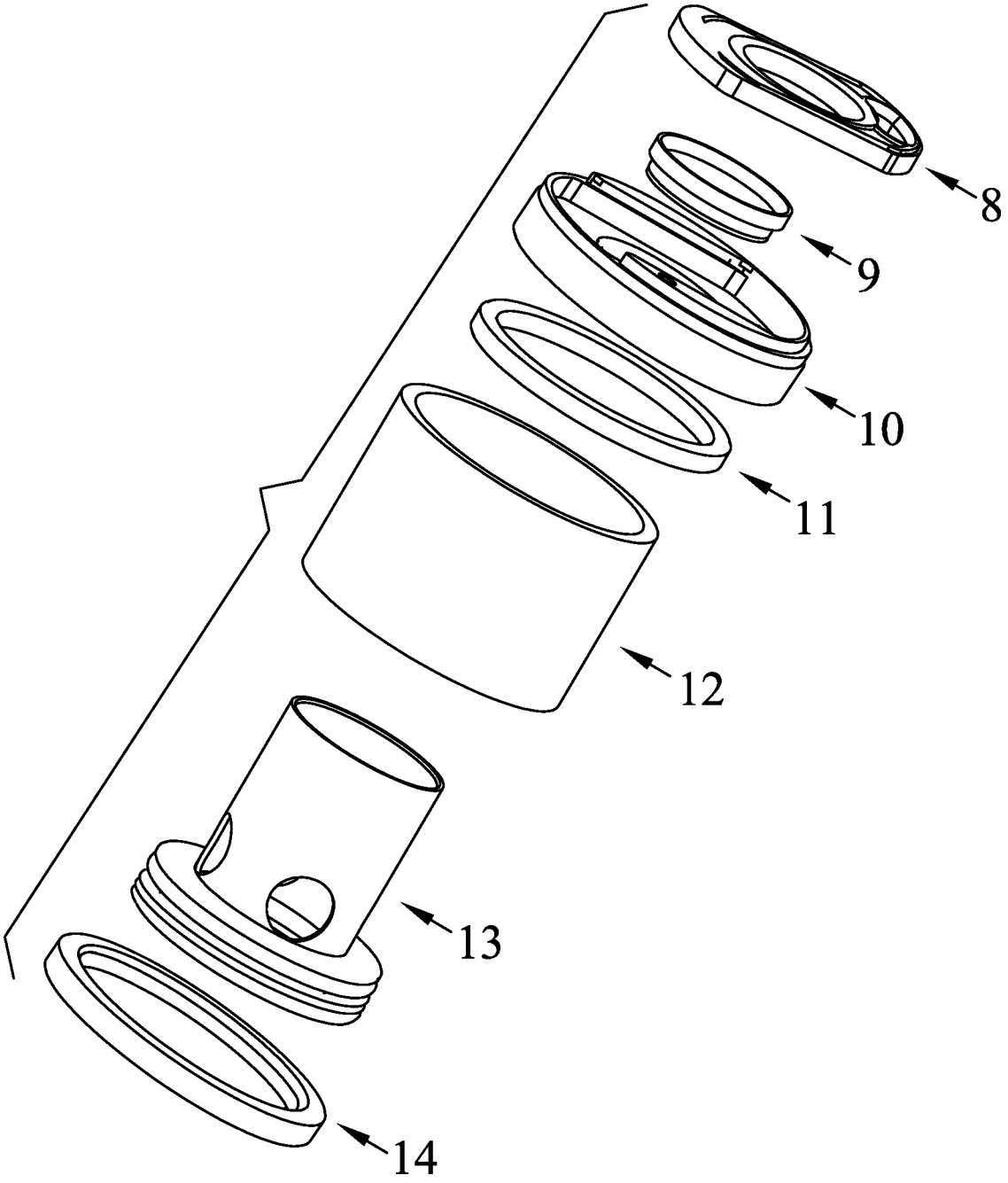
FIG. 3 is an exploded view of an e-liquid storage subassembly of an electronic cigarette of the disclosure.
Figure 4:
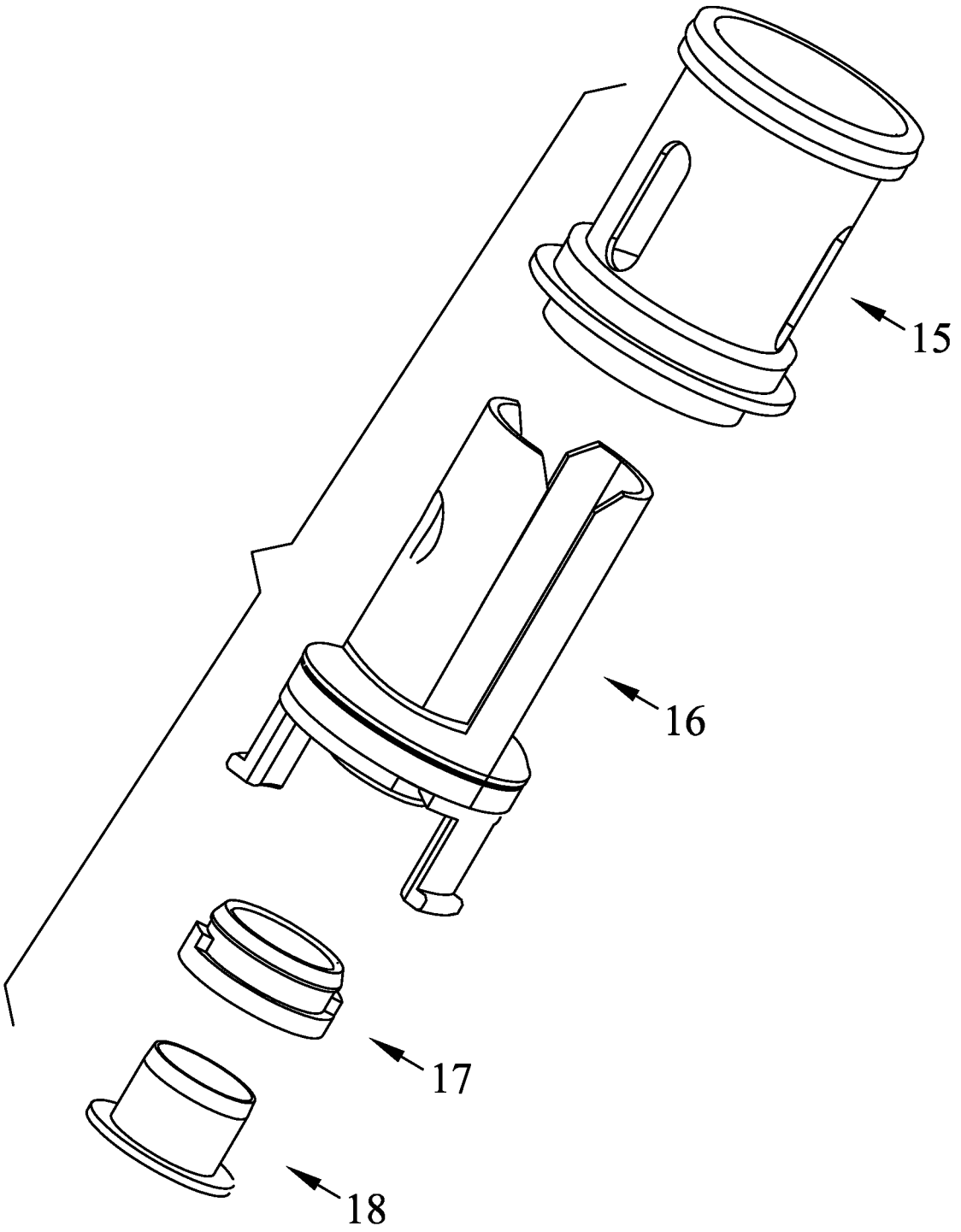
FIG. 4 is an exploded view of an atomizing subassembly of an electronic cigarette of the disclosure.
Figure 5:
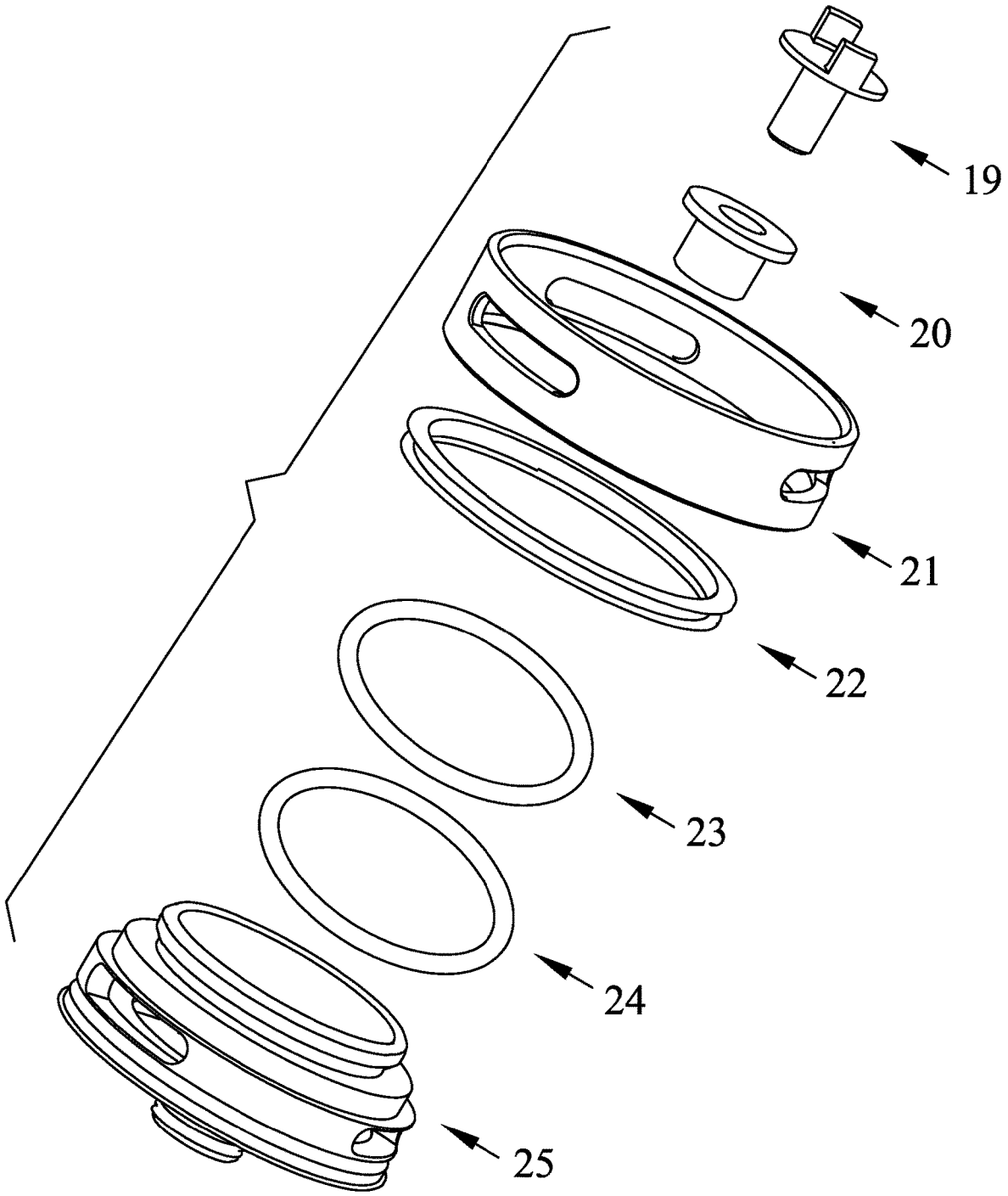
FIG. 5 is an exploded view of a base subassembly of an electronic cigarette of the disclosure
Figure 6:
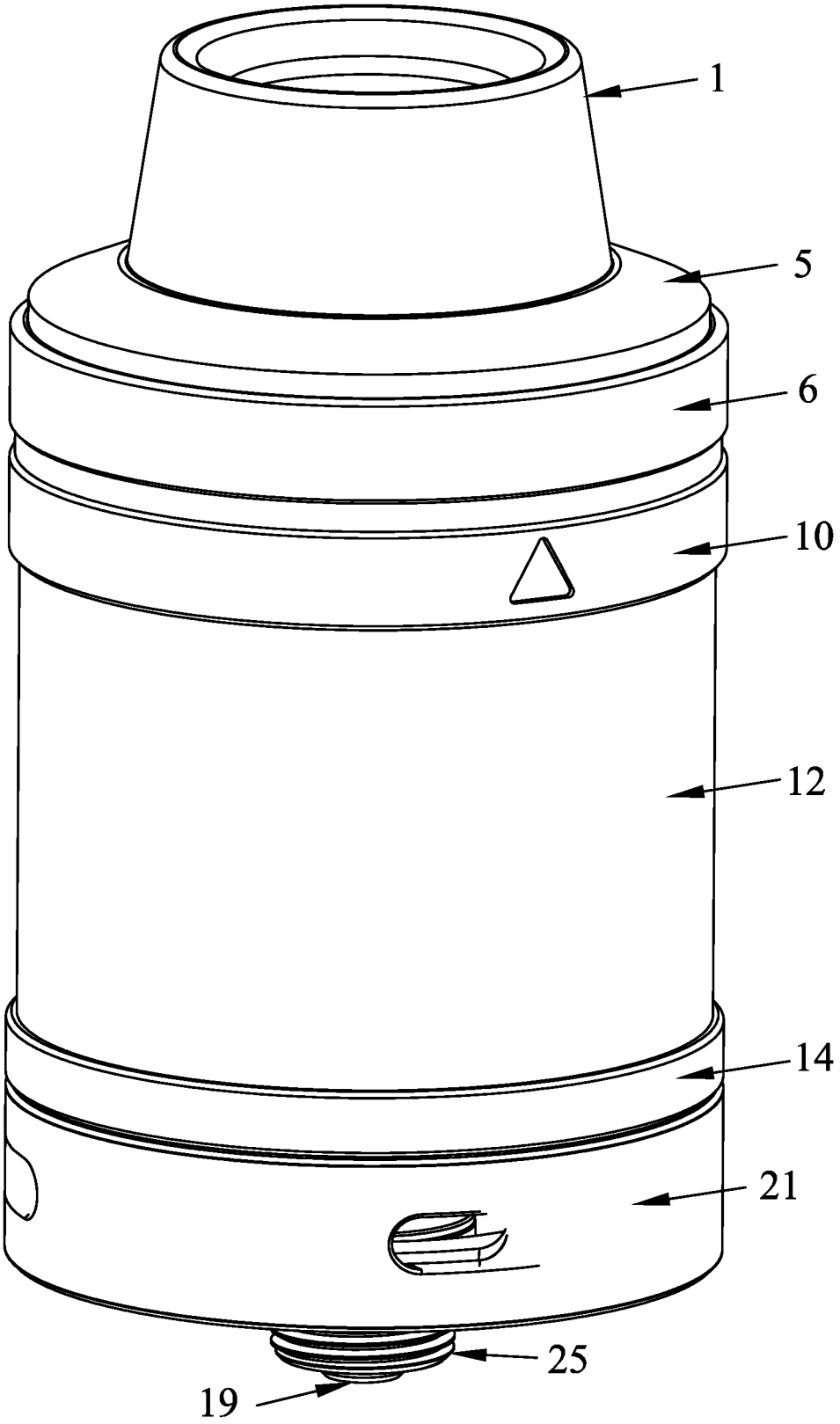
FIG. 6 is a stereogram of an electronic cigarette of the disclosure.
Figure 7:
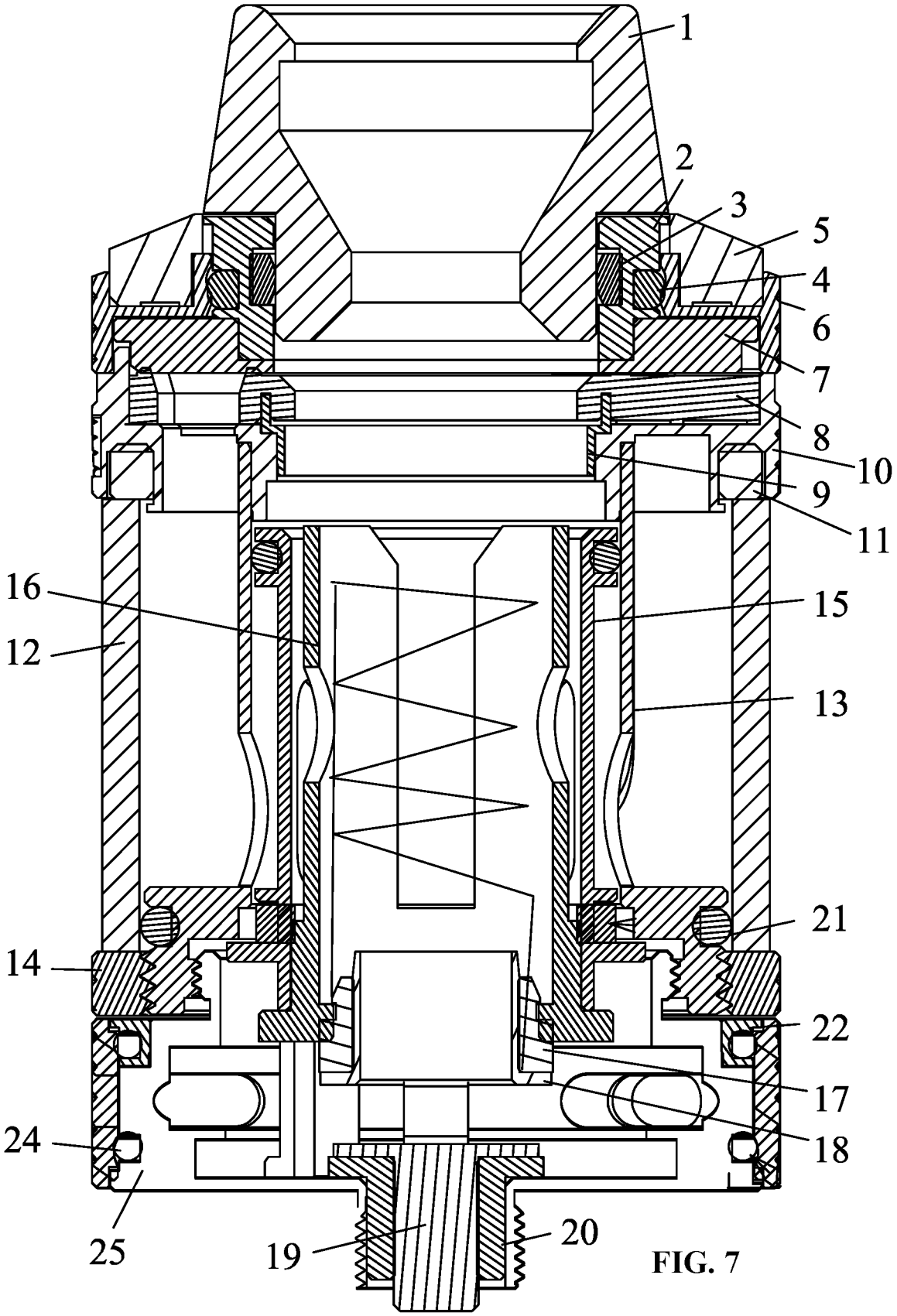
FIG. 7 is a sectional view of an electronic cigarette of the disclosure.

For further illustrating the invention, experiments detailing an electronic cigarette are described below. It should be noted that the following examples are intended to describe and not to limit the invention.

The disclosure provides an electronic cigarette comprising: a mouthpiece subassembly A; an e-liquid storage subassembly B; an atomizing subassembly C; and a base subassembly D. The mouthpiece subassembly is mounted on the e-liquid storage subassembly; the atomizing subassembly is disposed in the e-liquid storage subassembly; the base subassembly is connected to the e-liquid storage subassembly.

The mouthpiece subassembly A comprises a cigarette holder 1, a fixed cover 2, a first seal ring 3, a first fixed ring 4, a decoration cover 5, a flexible cover 6, and a sliding part 7; the cigarette holder 1 is inserted in the fixed cover 2; the first seal ring 3 is disposed in the fixed cover 2 to seal the cigarette holder 1; the first fixed ring 4 is disposed outside the fixed cover 2 to fix the flexible cover 6; the decoration cover 5 is disposed on the flexible cover 6; the sliding part 7 is disposed at a bottom of the flexible cover 6.

The e-liquid storage subassembly B comprises an e-liquid leakproof part 8, a silica fixed ring 9, a second fixed ring 10, a second seal ring 11, a glass tube 12, a hollow threaded column 13, and a third fixed ring 14; the e-liquid leakproof part 8 and the silica fixed ring 9 are fixed on the second fixed ring 10; the glass tube 12 sleeves the hollow threaded column 13; the second seal ring 11 is disposed in the second fixed ring 10 to seal the glass tube 12; the second fixed ring 10 is disposed on the hollow threaded column 13; the third fixed ring 14 is screwed on the hollow threaded column 13 to fix the glass tube 12; the second fixed ring 10 comprises a groove which corresponds to the sliding part 7 of the mouthpiece subassembly; the e-liquid storage subassembly is connected to the mouthpiece subassembly via the cooperation of the sliding part 7 and the second fixed ring 10.

The atomizing subassembly C comprises a limit cover 15, a heating wire support 16, an insulation ring 17, and an electrode 18; the electrode 18 is embedded in the insulation ring 17; the insulation ring 17 is disposed in the heating wire support 16; the heating wire support 16 is disposed in the limit cover 15; the atomizing subassembly is disposed in the hollow threaded column 13.

The base subassembly D comprises a joint 19, a protective part 20 of the joint 19, a vapor adjusting ring 21, a fourth fixed ring 22, a third seal ring 23, a fourth seal ring 24, and a base 25; the base subassembly D is connected to the atomizing subassembly C via the joint 19; the protective part 20 and the joint 19 are sequentially disposed in the base 25; the vapor adjusting ring 21 is fixed on the fourth fixed ring 22; the third seal ring 23 seals the base, and the fourth seal ring 24 seals the vapor adjusting ring 21; the fourth seal ring 24, the fourth fixed ring 22, and the third seal ring 23 are sequentially disposed on the base 25; the vapor adjusting ring 21 is screwed on the base 25; the base 25 is screwed on the hollow threaded column 13 of the e-liquid storage subassembly.

Preferably, as an improvement, the flexible cover 6 is slidably disposed on the second fixed ring 10; the second fixed ring 10 comprises a side wall; the side wall is provided with an orifice allowing the e-liquid to pass through; and the flexible cover 6 is capable of sliding on the side wall to seal the orifice. The mouthpiece subassembly is mounted on the e-liquid storage subassembly. The sliding part 7 of the mouthpiece subassembly slides into and is locked by the groove of the second fixed ring 10 of the e-liquid storage subassembly, thus making the mouthpiece subassembly and the e-liquid storage subassembly connected. The cigarette holder 1 is a common cigarette holder 1 on the market, and is easy to replace. In use, the flexible cover 6 is pushed aside, the orifice on the side wall of the second fixed ring 10 is exposed, so that the e-liquid can be charged into the atomizer of the electronic cigarette, achieving the loading of the e-liquid from the top part of the electronic cigarette through a push mode.

Preferably, as an improvement, the vapor adjusting ring 21 is in threaded connection to the base, and the vapor adjusting ring comprises a circumferential wall which is provided with a transverse and/or longitudinal hole. The vapor adjusting ring 21 is disposed at the bottom of the atomizer, and is in threaded connection to the base, so the rotation of the vapor adjusting ring 21 can change the output volume of the vapor, achieving the vapor adjustment through the bottom of the electronic cigarette. The atomizing subassembly is supported by the base subassembly. The base subassembly can be screwed out to replace the atomizing subassembly.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. An electronic cigarette, comprising:

a mouthpiece subassembly;

an e-liquid storage subassembly;

an atomizing subassembly; and a base subassembly;

wherein:

the mouthpiece subassembly is mounted on the e-liquid storage subassembly;

the atomizing subassembly is disposed in the e-liquid storage subassembly;

the base subassembly is connected to the e-liquid storage subassembly;

the mouthpiece subassembly comprises a cigarette holder, a fixed cover, a first seal ring, a first fixed ring, a decoration cover, a flexible cover, and a sliding part; the cigarette holder is inserted in the fixed cover; the first seal ring is disposed in the fixed cover to seal the cigarette holder; the first fixed ring is disposed outside the fixed cover to fix the flexible cover; the decoration cover is disposed on the flexible cover; the sliding part is disposed at a bottom of the flexible cover;

the e-liquid storage subassembly comprises an e-liquid leakproof part, a silica fixed ring, a second fixed ring, a second seal ring, a glass tube, a hollow threaded column, and a third fixed ring; the e-liquid leakproof part and the silica fixed ring are fixed on the second fixed ring; the glass tube sleeves the hollow threaded column; the second seal ring is disposed in the second fixed ring to seal the glass tube; the second fixed ring is disposed on the hollow threaded column; the third fixed ring is screwed on the hollow threaded column to fix the glass tube; the second fixed ring comprises a groove which corresponds to the sliding part of the mouthpiece subassembly; the e-liquid storage subassembly is connected to the mouthpiece subassembly via the cooperation of the sliding part and the second fixed ring;

the atomizing subassembly comprises a limit cover, a heating wire support, an insulation ring, and an electrode; the electrode is embedded in the insulation ring; the insulation ring is disposed in the heating wire support; the heating wire support is disposed in the limit cover; the atomizing subassembly is disposed in the hollow threaded column; and the base subassembly comprises a joint, a protective part of the joint, a vapor adjusting ring, a fourth fixed ring, a third seal ring, a fourth seal ring, and a base; the base subassembly is connected to the atomizing subassembly via the joint; the protective part and the joint are sequentially disposed in the base; the vapor adjusting ring is fixed on the fourth fixed ring; the third seal ring seals the base, and the fourth seal ring seals the vapor adjusting ring; the fourth seal ring, the fourth fixed ring, and the third seal ring are sequentially disposed on the base; the vapor adjusting ring is screwed on the base; the base is screwed on the hollow threaded column of the e-liquid storage subassembly.

2. The electronic cigarette of claim 1, wherein the flexible cover is slidably disposed on the second fixed ring; the second fixed ring comprises a side wall; the side wall is provided with an orifice allowing the e-liquid to pass through; and the flexible cover is capable of sliding on the side wall to seal the orifice.

3. The electronic cigarette of claim 1, wherein the vapor adjusting ring is in threaded connection to the base, and the vapor adjusting ring comprises a circumferential wall which is provided with a transverse and/or longitudinal hole.

4. The electronic cigarette of claim 2, wherein the vapor adjusting ring is in threaded connection to the base, and the vapor adjusting ring comprises a circumferential wall which is provided with a transverse and/or longitudinal hole.

* * * * *